US008526654B2

(12) United States Patent
Gaudriot et al.

(10) Patent No.: US 8,526,654 B2
(45) Date of Patent: Sep. 3, 2013

(54) ACOUSTIC WAVE GENERATION DEVICE AND EQUIPMENT INCLUDING A PLURALITY OF SUCH DEVICES

(75) Inventors: Didier Gaudriot, Gap (FR); Lionel Gaudriot, Dommartin (FR)

(73) Assignee: Didson, Gap (FR)

( * ) Notice: Subject to any disclaimer, the term of this patent is extended or adjusted under 35 U.S.C. 154(b) by 115 days.

(21) Appl. No.: 13/321,327

(22) PCT Filed: Apr. 27, 2010

(86) PCT No.: PCT/FR2010/050794

§ 371 (c)(1),
(2), (4) Date: Nov. 18, 2011

(87) PCT Pub. No.: WO2010/133782

PCT Pub. Date: Nov. 25, 2010

(65) Prior Publication Data

US 2012/0061173 A1 Mar. 15, 2012

(30) Foreign Application Priority Data

May 20, 2009 (FR) ..... 09 53399

(51) Int. Cl.

| | |
|---|---|
| ***H04R 1/02*** | (2006.01) |
| ***H04R 9/06*** | (2006.01) |
| ***H04R 1/20*** | (2006.01) |
| ***G08B 3/02*** | (2006.01) |

(52) U.S. Cl.
USPC ..... 381/336; 381/345; 181/139

(58) Field of Classification Search
USPC ..... 381/332, 336, 337, 338, 87, 150, 381/345, 386; 181/139, 198, 199; 310/313 R
See application file for complete search history.

(56) References Cited

U.S. PATENT DOCUMENTS

| | | | | |
|---|---|---|---|---|
| 5,491,309 | A * | 2/1996 | Kotter | 181/285 |
| 5,804,775 | A * | 9/1998 | Pinnington | 181/200 |
| 6,388,360 | B1 * | 5/2002 | Nysen et al. | 310/313 R |
| 6,463,156 | B1 | 10/2002 | Gaudriot et al. | |
| 6,753,583 | B2 | 6/2004 | Stoffel et al. | |
| 2006/0076851 | A1 * | 4/2006 | Fujimoto et al. | 310/313 R |
| 2007/0071272 | A1 | 3/2007 | Oliver et al. | |

FOREIGN PATENT DOCUMENTS

| | | | |
|---|---|---|---|
| DE | 2139941 | A1 | 3/1973 |
| DE | 19503728 | A1 | 8/1996 |
| EP | 0787340 | A1 | 8/1997 |
| EP | 1094444 | A1 | 4/2001 |

OTHER PUBLICATIONS

European Patent Office, International Search Report, dated Aug. 9, 2010 (2 pgs).

* cited by examiner

*Primary Examiner* — Tuan D Nguyen
(74) *Attorney, Agent, or Firm* — Harris Beach PLLC

(57) ABSTRACT

Device for generating acoustic waves comprising an assembly of substantially parallel deformable walls, made of a conductive elastomer material, the series of walls delimiting contiguous spaces therebetween alternately leading over two opposite surfaces of said assembly into two cavities, that are sealed relative to one another; and a rigid revolving chamber containing the assembly and having two sealed cavities opposite two surfaces. Two circular screened slots formed in the chamber define two vents that ensure communication between the cavities and the external acoustic medium. Means are also provided for applying, in a controlled and variable manner, a set of electric potentials to the walls in order to induce an electric field between the walls, consecutively active, and inactive for a control polarity, and inactive and active for the opposite polarity, so as to decrease the space covered by the field, i.e. and in series, and to thus equally increase the contiguous space.

14 Claims, 4 Drawing Sheets

ACOUSTIC WAVE GENERATION DEVICE AND EQUIPMENT INCLUDING A PLURALITY OF SUCH DEVICES

CROSS REFERENCE TO RELATED APPLICATIONS

This application is a National Stage filing under 35 U.S.C.§371 of PCT Application No. PCT/FR2010/050794, filed Apr. 27, 2010. This application also claims the benefit of French Application No. 0953399, filed May 20, 2009. The entirety of both applications is incorporated herein by reference.

FIELD OF THE INVENTION

The invention relates to the field of electro-acoustic sources, and more specifically to sources intended to operate in networks in order to generate extended acoustic wave systems shaped so as to conform to very specific surfaces. The generation of such waves is required for use in active noise control and detection or imaging, and to a lesser degree for use in sound reproduction.

It relates more specifically to a new electro-acoustic dipole structure, following the example of various unbaffled loudspeakers, from which it is distinguished by a unitary pressure control function.

DESCRIPTION OF PRIOR ART

The advantage of the invention is most obviously apparent when it is used in the active control of sound pollution, where screening in relation to incident waves carrying sound pollution in an open environment leads to the production of meshed networks of counter noise sources. These sources, by creating reflection at the non-material surface of the network, cause it to act as a screen, opaque to sound.

Solutions have been proposed, as described in particular in the documents DE2139941, EP 0787340 or EP 1 094 444. The systems described in these documents refer to the use of monopole or dipole acoustic sources constituted by ordinary loudspeakers controlled in a particular way.

The problem clearly posed by this type of acoustic source, whether it is based on a principle of electrodynamic, "electrostatic", or even piezoelectric translation, is that achieving an acoustic flow or pressure control function that is of necessity unitary, so as to obtain the required specific wave reflection, entails a response lag. Given the mechanical structure of these mechanical wave propagating sources, it is in fact necessary, in order to obtain said response, to apply to the control signal the inverse transfer function from that of the selected loudspeaker in order to compensate the mechanical resonance related poles thereof, the inevitable result of which is a delay in the overall loudspeaker transfer function.

Said delay is then very prejudicial in terms of screen design, in that it can only be compensated by picking up the acoustic signals carried by the incident noise waves upstream of the sources. Since the pre-lag so achieved then varies according to the wave incidences, the use of ordinary loudspeakers therefore entails pre-characterising these incident waves, which are numerous and may vary according to deleterious and generally mobile noise sources such as means of transport, by acoustic antennas that are adapted, entailing complex signal processing, and at all events very bulky.

Furthermore, the use of monopole sources entails modulating the flow-rate thereof according to the normal speed component at the screen surface, which means this speed has to be measured; with dipole sources, a counter-pressure has to be opposed to the incident acoustic pressure, a pressure that is more easily accessible to measurement with a microphone.

It may also be added that ordinary monopole sources are in fact constituted by fundamentally dipole sources with two speaker surfaces, which are baffled in order to prevent the external action of one of the surfaces. The result is an increase in size that is prejudicial to use in active noise control in particular, where their compactness needs to contribute to the visual transparency of the screens.

These various drawbacks therefore naturally encourage the search for a compact dipole source with an intrinsically unitary control function and with no response lag.

The arguments put forward in respect of active noise screening applications remain fully pertinent, although less pressing in nature, when producing acoustic source networks intended either for detection or imaging, or for sound reproduction, the same source principle being applicable to any acoustic medium, gaseous or liquid.

The problem the invention sets out to resolve is therefore that of producing compact, dipole electro-acoustic sources with unitary pressure response and with no response lag.

SUMMARY OF THE INVENTION

The invention relates to a dipole device for generating acoustic waves, i.e. to be more precise, pairs of acoustic waves of opposite pressure, propagating in each direction the opposite way, parallel to discontinuity surfaces defined by the geometry of the source network and the respective lags of the controls applied to the sources, themselves dipole.

The pressure differential resulting from this wave pair at the discontinuity surfaces has the effect of coupling the variable dipole flow created by the sources themselves with the external acoustic medium.

In these conditions, these sources are defined locally as dipole, i.e. anti-symmetrical, pumps, with two vents, generating flow in the ambient fluid. This electrically insulating fluid, air or liquid may be considered as incompressible in the operating conditions of the pump (near acoustic field conditions) in the frequency field of application of the dipole.

The acoustic coupling of this flow is such that the pressure differential created in respect of such wave pairs is strictly proportionate to the general pressure differential which generates the flow in the pump constituting the source. It is modulated by a directivity factor depending on the direction of the pairs.

The invention therefore relates more specifically to a device for generating local dipole flow with the pressure differential thereof being controlled.

In accordance with the invention this device is characterised in that it comprises an assembly of substantially identical and plane, parallel deformable walls made of electrically conductive material. These walls are stacked uniformly, and to advantage separated by plane spacers of equal thickness, so as to define therebetween a series of confined, substantially identical spaces, alternately leading over two opposite surfaces of said assembly through appropriate apertures.

It also comprises a chamber which contains this assembly of walls and has two cavities opposite the surfaces to which the apertures of the defined spaces lead, confined between the walls. These cavities themselves communicate with the external environment via two revolving apertures constituting the two symmetrical vents of the dipole.

This device also comprises means for applying, in a controlled and variable way, an electric field between pairs of consecutive walls, so as to create a pressure differential between pairs of contiguous spaces, the electric field being applied alternately to one of the spaces, to the exclusion of the other, according to the sign of the pressure differential to be created. This pressure differential itself causes the opposite walls to move apart and draw closer in succession, thereby inducing opposite variations in space which bring about the requisite alternate dipole flow. This flow is established outside the chamber through the two vents by which it is reclosed.

Put another way, the inventive device acts by causing the alternate opposite deformation of multiple spaces, leading to two vents, spaces which by contracting and expanding consecutively, in space and in time, suck in or discharge the fluid they contain, in equal amounts and create from these vents an external velocity potential flow, dipole and quasi-revolving in nature.

Thus, when the electric field is applied in an inter-wall space the walls concerned are alternately attracted or not attracted towards one another, as a result of which the corresponding space decreases by an amount equal to that by which the connected space, where the field is not applied, increases. These variations therefore give rise to two flows of the opposite flows discharged by the two cavities and the two respective vents towards the surrounding space; these two flows thus generate an externally revolving flow field the current lines of which emerge from one of the vents in order to re-enter through the other.

A dipole structure potential flow is thus generated of a type to give rise, through the combined laws of fluid mechanics and acoustics, to a system of acoustic wave pairs propagating in opposite directions and signals, and whereof the discontinuity plane passes through the centre of symmetry of the vents. This device thereby constitutes an acoustic dipole source.

More specifically, the inventive device serves to control electrically the differential pressure underlying the dipole flow, and thereby the pressure differential of the pairs of acoustic waves induced by said flow.

In the particular case where the device is used in active anti-noise screening, such devices are distributed in great number, over a plane surface, according to a wide-ranging uniform network of geometric pitch 'a'. As a result the flow of each device is ideally coupled acoustically with a single pair of acoustic waves, the fundamental waves of the network, alone generated for an acoustic signal frequency spectrum bounded at the upper end at the network cut-off frequency (fo), i.e. fo # c/a (where 'c' is the speed of sound, and 'a' the geometric pitch of the network). Thus, by combining a plurality of characteristic devices, arranged in a network, and controlled from the same reference signal, with appropriate respective delay laws, it is possible to shape the acoustic wave pair emitted to conform to adjustable forms and inclinations.

In these conditions, by applying BERNOULLI's theorem to the time-variable velocity potential flow, following any closed current line passing through a single wall on the one hand, and therefore two contiguous internal spaces, and the network plane on the other hand, it is established that the pressure differential generated inside the device across the wall is the strict opposite of the pressure differential resulting between the two fundamental acoustic waves created at the network surface, in anti-noise, i.e. total zero acoustic flow condition. As it happens the jump of potential derivatives at these two crossover points is compensated by an opposite jump of pressure, said jump of derivative being related to the acceleration waves arising at the network surface.

In radiation conditions, in clear space, the pressure differential between the fundamental acoustic waves generated is only a specific fraction of the differential pressure internal to the device, because of the inertial pressure drop arising in the very close field flows, adapting those of the dipole to those of the waves produced.

Put another way, the transfer function between the pressure differentials is unitary, which constitutes the first fundamental property required for an anti-noise application, and a particularly advantageous property in other applications.

Added to this property is the second property of a much reduced response lag between these two pressures, in so far as the size of the device, added to the acoustic wave length, is small enough to be able to overlook the potential propagation delays: this is a second requisite property for an anti-noise application.

In practice, mechanically speaking, the various walls of the device are defined and separated by sealed U-shaped spacer elements of constant thickness. The open portions of these elements, stacked head to foot, are alternately oriented towards one or other of the surfaces to which the spaces defined between the different walls lead, surfaces that themselves communicate with one or other of the vents of the dipole.

Put another way, the spaces created between the walls are defined on the one hand, by the walls themselves, and on the other hand by a spacer element, keeping the walls apart and also defining the space through which the fluid will flow transversely, entering or leaving according to the movement of the walls.

In normal operating conditions, the pressure differential created electrically between the walls is balanced by the accumulated inertial resistances of the flows external to the dipole: flows towards the acoustic waves and direct short-circuit flows between the two vents; this latter flow remaining present in anti-noise conditions whereas the previous ones are cancelled as already mentioned.

Two particular parameters play an active part in the operation of the device:

The flows internal to the device are defined by the inter-wall spacing, regulated by the thickness of the spacers, and the inertial characteristics of the resilient walls. They are laminar, predominantly governed by the inertial effects. An appropriate parametric choice serves to minimise the resulting overall inertial charge.

Next comes the choice of material and of wall thickness. Obtaining a unitary transfer function entails the resilient walls having, in the acoustic frequency range under consideration, a predominant inertial behaviour, which imposes a first natural frequency of the wall membrane stretched over the U-shaped spacer that is sufficiently low relative to the average frequency of the spectrum. As a result the choice of material falls preferentially on an elastomer material with a very low YOUNG's modulus (typically about 0.01 GPa), loosely stretched over the spacers and quite thin (a few tenths of mm approx).

As regards the principles for controlling the electric fields intended to create the attractive mechanical inter-wall tensions, said tensions being the source of the pressure differentials between contiguous spaces, the device collects the walls to advantage into sub-assemblies of four walls. These sub-assemblies form repetitive juxtaposed patterns, wherein the walls in same row in each sub-assembly are controlled by one and the same electric control potential: i.e. $V_1(t)$, $V_2(t)$, $V_3(t)$, $V_4(t)$ defined from a common alternating control potential $V_0(t)$, itself generated, electronically, from the pressure differential signal to be delivered by the device, i.e. $\Delta P_0(t)$, implementing the following function:

$$V_0(t) \propto \sqrt{|\Delta P_0(t)|}$$

In these conditions, on the walls ordered consecutively, the potentials may be defined in the following non-exclusive manner:

On the first wall, $V_1(t)=0$, i.e. the potential remains constant

On the third wall, $V_3(t)=V_0(t)$

On the second wall, $V_2(t)=V_0(t)\times\{\text{HEAVISIDE step function } [+\Delta P_0(t)]\}$ On the fourth wall, $V_4(t)=V_0(t)\times\{\text{HEAVISIDE step function } [-\Delta P_0(t)]\}$ It will be observed that $V_0(t)$ is created from the square root of the modulus of the pressure to be delivered in order to take into account the fact that the electrostatic attraction obtained is proportionate to the square of the electric field, for the transfer function linearity imperative. Thus, the pressure differential of the wave pairs generated is proportionate to the control pressure differential $\Delta P_0(t)$, and these two types of differentials are concomitant in the conditions of use of the dipole.

Moreover, the electric potentials $V_1(t)$, $V_2(t)$, $V_3(t)$, $V_4(t)$ are not directly applied to the walls since with the vibration of these walls, the charges induced at the surface thereof are not perfectly proportionate. They are therefore applied through the appropriate electronic control circuits which correct them such that it is the injected electrical charges which are actually proportioned to the set: $V_2$, $V_3$, $V_4$, so as to preserve the linearity of the transfer function. The pressure differential created in the inter-wall spaces has in fact an amplitude strictly proportionate to the square of the fields, and therefore of the electrical charges injected on the walls.

In practice, the dielectric rigidity of the medium defines the maximum applicable potentials and therefore the maximum amplitude of the acoustic pressure differential which the device is able to deliver.

In order to generate acoustic wave pairs as set, the device may to advantage comprise two microphonic sensors, in proximity to the two vents respectively, so as to evaluate the pressure differential actually generated and correct the control via an appropriate electronic control loop.

BRIEF DESCRIPTION OF THE DRAWINGS

The way in which the invention is embodied, as well as the resulting advantages will become clear from the description of the following embodiment, supported by the appended drawings wherein.

DESCRIPTION OF THE PREFERRED EMBODIMENTS

Figure 1:
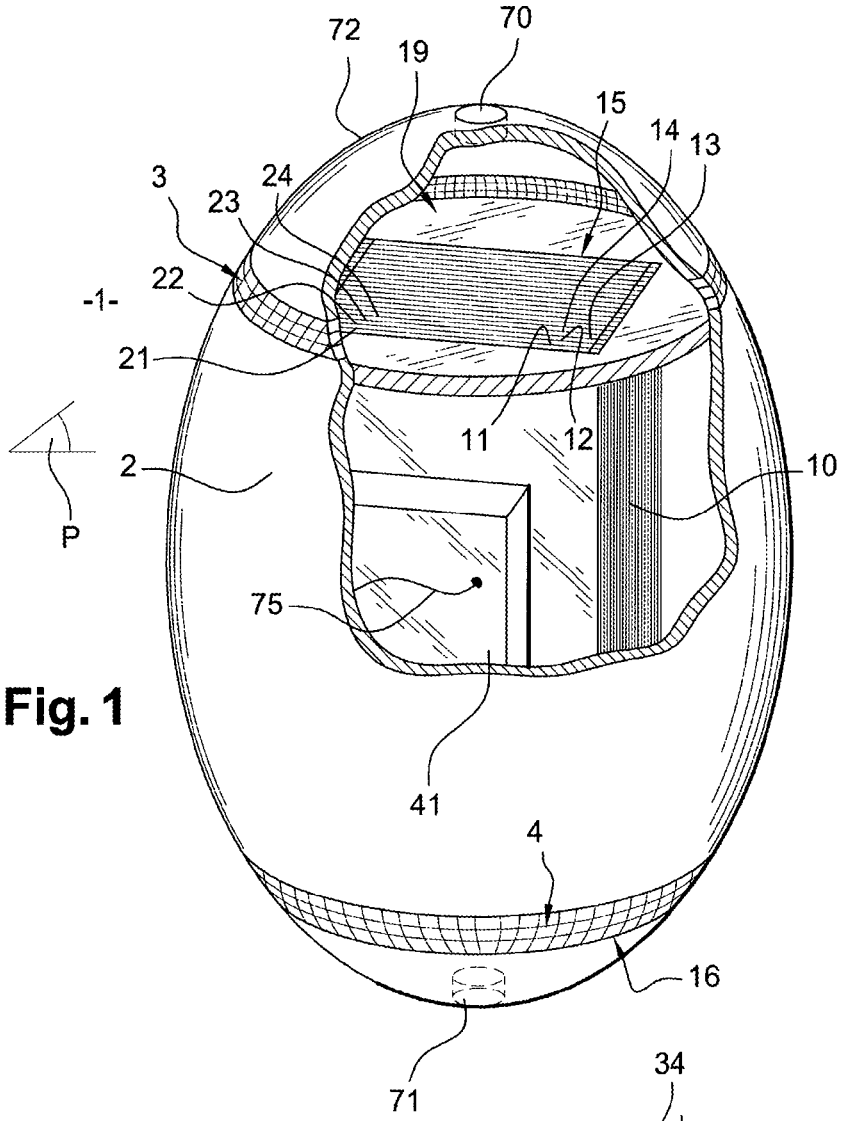
FIG. 1 is a partially skinned outline perspective view of an inventive device.

As shown in FIG. 1, the inventive device 1 comes in the form of a revolving chamber 2 that has two circular apertures or vents 3, 4 arranged symmetrically relative to the median plane P. The general shape of this chamber will be generally ellipsoidal, elongated along the axis of the dipole as shown in FIG. 1, or on the contrary flattened along this same axis according to the dimensions of the active body 10, or else adapted from such a shape depending on the intended use.

The chamber 2 encloses an assembly 10 of walls 11, 12, 13, 14 separated by spacer elements 21, 22, 23. This wall assembly 10 has two preferred surfaces 15, 16, which lead to two internal cavities 17, 18, sealed internally on the periphery of the assembly 10, by two rigid diaphragms 19 connecting the external outlines of the planes 15, 16 and that of the chamber 2.

The cavities 17, 18 are capped with two rigid caps 35, 36 which close the chamber, while having at their base two circular screened apertures, of cross-section adapted to the flows, constituting two vents 3, 4 which ensure they are in communication with the external environment.

The device 1 also includes electronic control means 41, distributed in the space available around the assembly 10, and in particular the four spaces formed between the wall assembly 10 and the chamber. These control means generate the electric potentials applied to the walls 11, 12, 13, 14.

In the form shown the device also includes two pressure sensors 70, 71 connected to the electronic control 41 to provide various programmed control functions.

Figure 2:
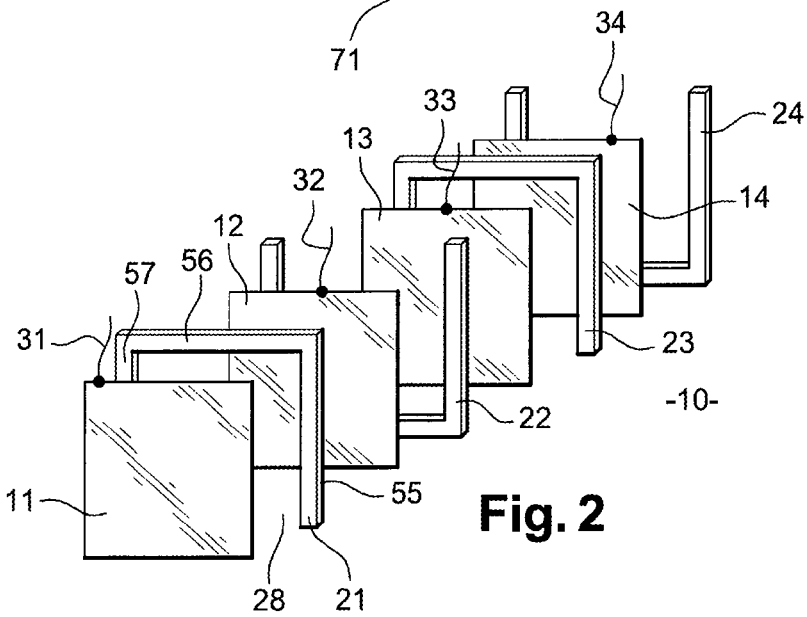
FIG. 2 is an exploded outline perspective view of the wall assembly of the device in FIG. 1.

As shown in FIG. 2, the wall assembly 10 is formed by joining various elements. Obviously, the number of walls shown in FIG. 2 is intentionally reduced, to facilitate understanding.

First of all, the walls as such are constituted by stretched deformable membranes that are electrically conductive. To be more precise, these membranes are made from films of conductive elastomer materials typically having a secant Young's modulus of about 0.01 GPa, for a thickness of about a few tenths of millimetres, for an operation in air acoustics.

The general shape of these membranes may be as in the form shown, square or rectangular. However, the invention is not restricted to this specific geometry, and other shapes may be adopted to meet considerations of optimum use of the available internal space.

Each of the walls 11-14 has an electrical connection 31-34 for connecting, as will be explained below, with variable potentials.

The various membranes 11-14 are separated by insulating spacer elements 21-24 of constant thickness, of about one millimeter in air.

To be more precise, each spacer element has a general U-shape, which in the form shown comprises three branches 55, 56, 57, which are arranged on three sides of the perimeter of the walls 11-14. Obviously, in the event of these walls not being square in shape, the spacer elements extend over only one part of their perimeter, so as to define an aperture zone 28 to connect the closed space between two consecutive walls 11, 12 and the cavity 17, 18.

In accordance with the invention, two consecutive spacer elements 21, 22 are placed head to foot, so that their apertures are alternately oriented towards the two opposite surfaces 15, 16 of the assembly. Put another way, the spaces defined between the walls 11, 12 and the walls 12, 13 are open in opposite directions.

In a form that is not shown, it is possible to implement a membrane bonded to a spacer, in order in particular to facilitate the assembly operations. An assembly is thus obtained that combines the membrane and the spacer in a general U-shape. Firstly, the spacer is made by moulding an insulating plastic material that is to advantage fibre-reinforced, according to an impression of the U-shape. From this spacer, and a shim fitting into the internal part of the U, an impression is made, which by pressing and vulcanisation serves to obtain the membrane of the requisite bonded thickness. It will be observed to advantage that removing the elastomer material of the membrane, after moulding, imparts to the membrane a favourable mechanical pre-tension.

Figure 3:
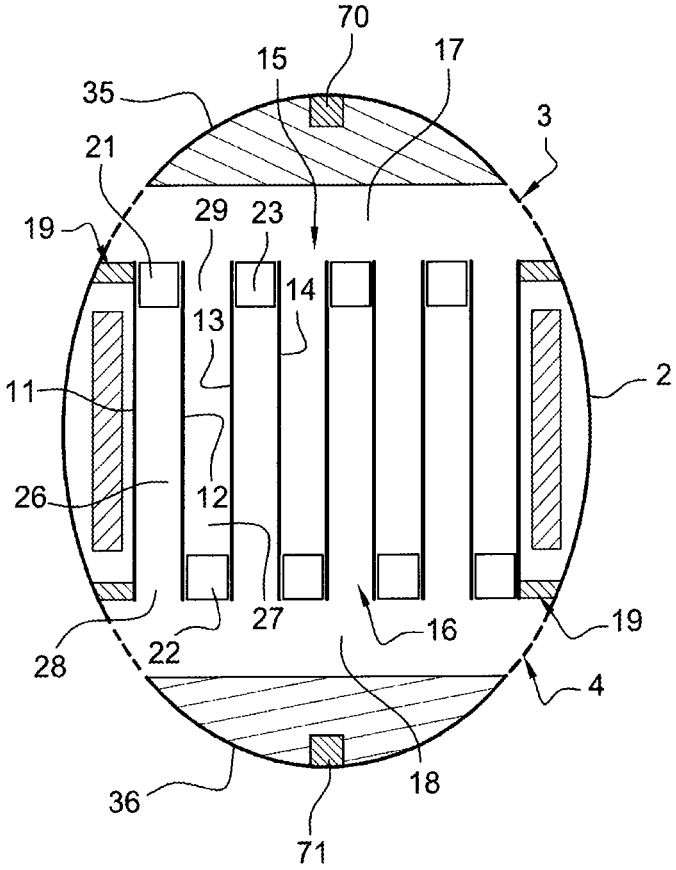
FIG. 3 is a longitudinal cross-section view of the device in FIG. 1.

After assembly, and as shown in FIG. 3, the membrane assembly 10 therefore comprises a succession of spaces 26, 27 which communicate with the outside via apertures 28, 29, oriented towards the opposite surfaces 16, 15 of the assembly opposite the cavities 18, 17 of the chamber 2.

Obviously, the dimensions and particularly the thickness of the various elements shown in the figures, and the number thereof, are given solely by way of illustration, and with the sole purpose of clarifying the invention. The real dimensions and numbers may in particular be distinctly different, depending on the type of fluid in which the device is operating and the uses, the thicknesses being increased by one order of magnitude in the liquid medium, and the elastomer material having to be made denser by the incorporation of appropriate charges.

Figure 4:
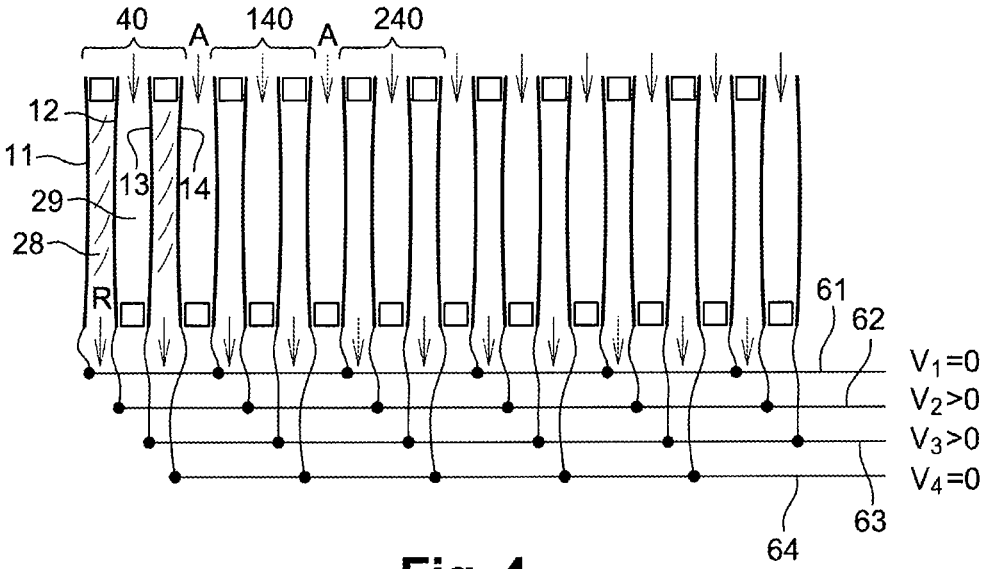
FIGS. 4 and 5 are diagrammatic cross-section views of the stacks of walls of an inventive device, shown in two opposite control states.

A shown in FIG. 4, the various walls are arranged in elementary patterns 40 of four walls.

Thus, the walls 11, 111, 211 of the consecutive patterns 40, 140, 240 are all connected to the common potential $V_1$. In the same way, the walls 12, 112, 212 are connected to a potential $V_2$, the walls 13, 113, 213 to the potential $V_3$ and the walls 14, 114 and 214 to the potential $V_4$. A way of generating these potentials as a function of the set pressure differential $\Delta P0(t)$ is described in FIG. 6.

In the state shown in FIG. 4, $V_1=0$, $V_2=V_3=V_0$, $V_4=0$, the walls 11, 12 and 13, 14 are attracted to each other to the exclusion of the others. It follows that the space 28 ejects fluid (arrow R) while the space 29 sucks it up (arrow A).

Figure 5:
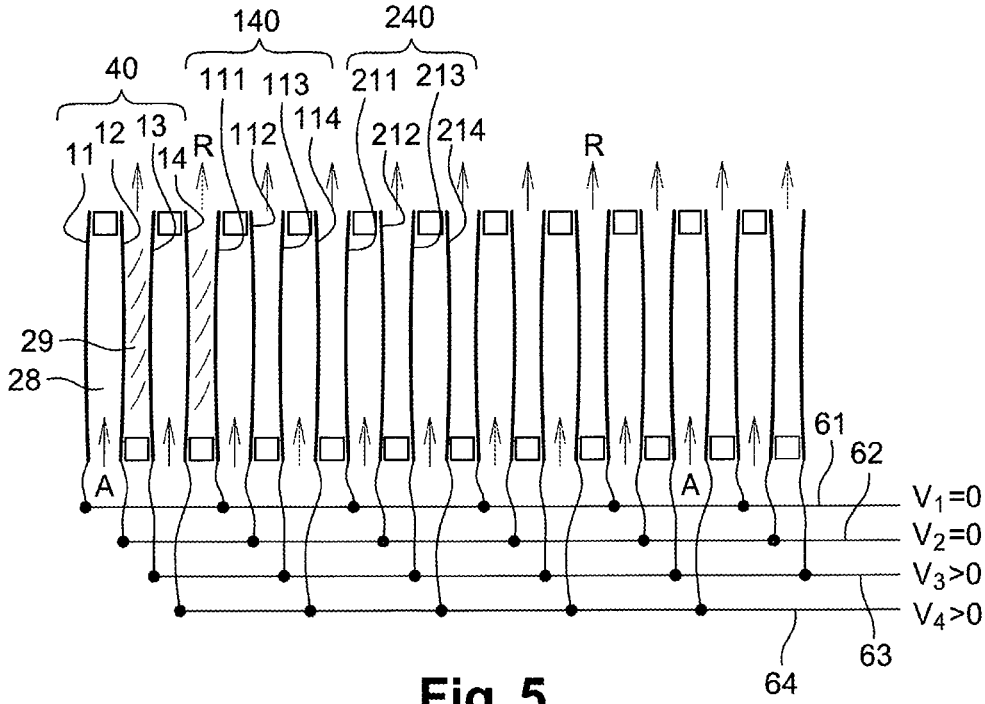

In the state shown in FIG. 5, $V_1=0$, $V_2=0$, $V_3=V_4=V0$, the walls 12, 13 are attracted to each other as well as 14 and 111. It follows that the space 29 ejects fluid (arrow R) while the space 28 sucks it up (arrow A).

Figure 6:
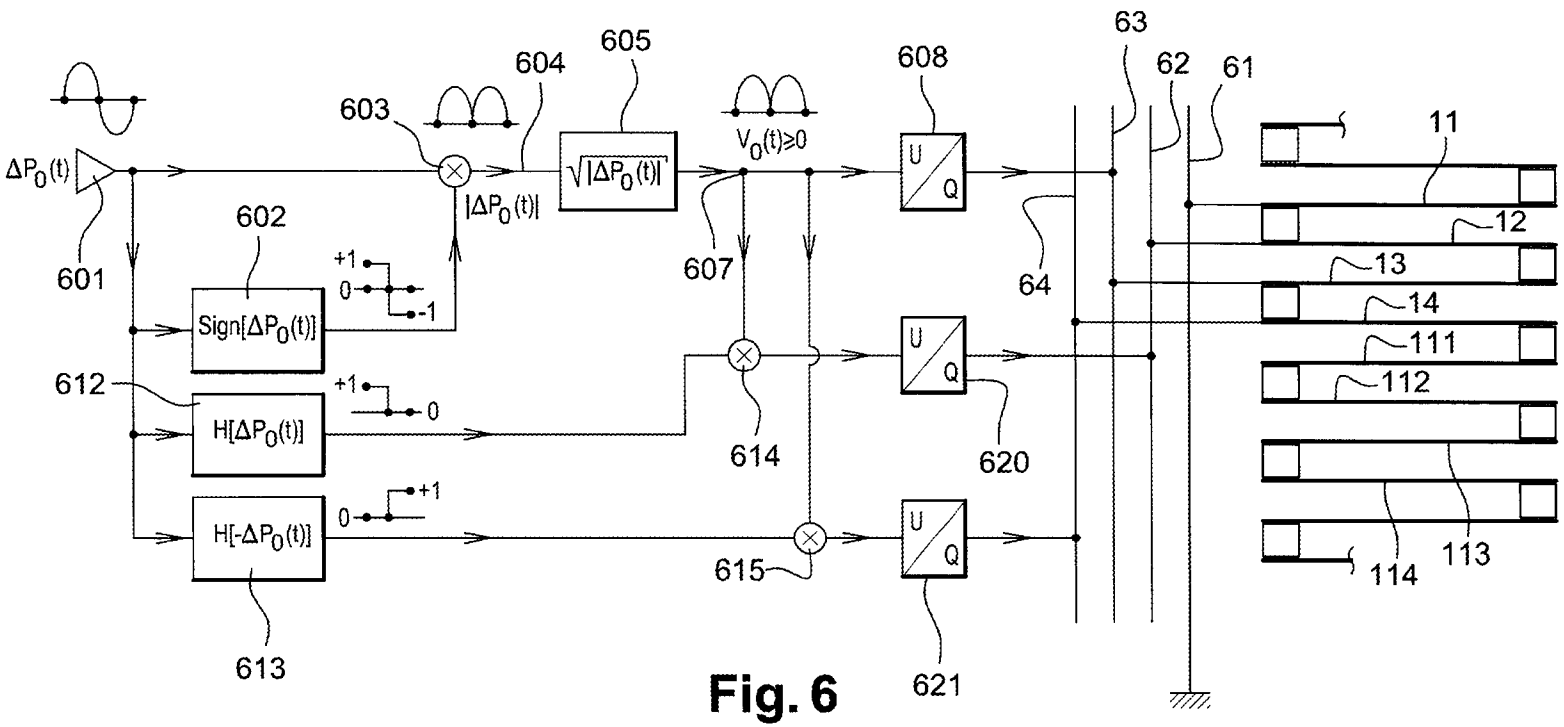
FIG. 6 is a simplified diagram showing the inventive chain of command.

As shown in FIG. 6, the electronic control unit ensures that the charges injected on the walls are proportioned, in amplitude, to the square root of the set pressure differential $|\Delta P_0(t)|$, whether or not multiplied by the appropriate HEAVISIDE steps of this differential. To be more precise, from the set pressure differential $\Delta P_0(t)$ supplied at output 601 of a calculation module, the sign of this differential is evaluated 602, so as to be able to multiply it 603 by the set pressure differential $\Delta P_0(t)$, and obtain 604 the absolute value $|\Delta P_0(t)|$. A module 605 determines the square root of this absolute value, which determines the control potential $V_0(t)$ present at 607. This potential value is converted into an electrical charge value by the converter 608, a charge injected in a bus 62 for supplying a quarter of the walls.

Complementarily, modules 612, 613 are used to calculate Heaviside step functions for the values of $\Delta P_0(t)$. To be more precise the output of the module 612 is a unitary signal for $\Delta P_0(t)$ positive, and nil for $\Delta P_0(t)$ negative. Conversely, the output of the module 613 is a unitary signal for $\Delta P_0(t)$ negative, and nil for $\Delta P_0(t)$ positive. These signals are multiplied by multipliers 614, 615 to give signals equal to $+V_0$ or nil depending on the sign of $\Delta P_0(t)$. These signals are applied at the input of the voltage-to-charge converters 620, 621 which supply the buses 63, 64, it being understood that the bus 61 remains at zero potential and that the bus 62 is controlled as disclosed above.

As a result of what has been said above the invention has the advantages of making it possible to generate acoustic waves whose pressure is a faithful and quasi-instantaneous replica of an electrical control signal, through the use of a compact device that is relatively straightforward to produce, the same principle being able to be applied to other fluid media both liquid and gaseous.

This device operates by generating a variable flow between multiple walls and by forming an external revolving flow field, dipole in nature. The total volume of fluid ejected by the inter-wall spaces as volume reduction, at the corresponding vent, is in fact sucked back up, in equal quantity, at the opposite vent, by the contiguous spaces as volume increase.

This variable dipole flow has the property of generating a system of acoustic wave pairs of opposite pressures, propagating themselves in opposite directions, these pressures being the faithful and quasi-instantaneous replica of the pressures created electrically in the contiguous spaces defined between the walls.

Obviously, all the constituent elements mentioned may be adapted to the particular, electrically insulating fluid medium in which the dipole is called to operate: gas or liquid, and will depend on various parameters of said medium, such as in particular its density, the acoustic wave velocity, as well as the use frequency range, which conditions in particular the total width and the number of spacers and membranes.

The invention claimed is:

1. Device for generating acoustic waves comprising:

an assembly of parallel deformable walls, made of an electrically conductive elastomer material, wherein the walls define successive spaces therebetween alternately leading over two opposite surfaces of said assembly, the mediator plane of the two surfaces constituting a plane of symmetry;

a rigid chamber containing said assembly of walls and having two symmetrical revolving cavities opposite the surfaces to which the spaces defined between the walls of said assembly lead, said cavities themselves leading to the surrounding space each by an orifice or vent;

means for applying in a controlled way, variable electric potentials to the walls collected into repetitive sub-assemblies of walls, potentials designed to create, alternately, electric fields in one inter-wall space in two.

2. Device of claim 1, wherein the various walls are separated by U-shaped spacer elements, the open portions of the spacer elements being alternately oriented towards one of other of the surfaces to which the spaces defined between the walls of the assembly lead.

3. Acoustic equipment including the device of claim 2, arranged in a network, and controlled from the same reference signal, with appropriate respective delay laws, so as to shape the pairs of acoustic waves emitted to conform to adjustable forms and incidences.

4. Device of claim 1, wherein the orifices leading to the surrounding space are circular and symmetrical relative to the mediator plane.

5. Acoustic equipment including the device of claim 4, arranged in a network, and controlled from the same reference signal, with appropriate respective delay laws, so as to shape the pairs of acoustic waves emitted to conform to adjustable forms and incidences.

6. Device of claim 1, wherein the walls are collected into identical sub-assemblies of four walls, the walls in the same position in the various sub-assemblies being connected to the same control potentials.

7. Acoustic equipment including the device of claim 6, arranged in a network, and controlled from the same reference signal, with appropriate respective delay laws, so as to shape the pairs of acoustic waves emitted to conform to adjustable forms and incidences.

8. Device of claim 1, further comprising control means suitable for generating the variable electric potentials to be applied to the walls, potentials themselves generated in order to inject the appropriate electrical charges to the sub-assemblies of walls.

9. Acoustic equipment including the device of claim 8, arranged in a network, and controlled from the same reference signal, with appropriate respective delay laws, so as to shape the pairs of acoustic waves emitted to conform to adjustable forms and incidences.

10. Device of claim 1, wherein the walls are made from a conductive elastomer material.

11. Acoustic equipment including the device of claim 10, arranged in a network, and controlled from the same reference signal, with appropriate respective delay laws, so as to shape the pairs of acoustic waves emitted to conform to adjustable forms and incidences.

12. Device of claim 1, comprising the axis of the vents, two symmetrical pressure sensors, capable of evaluating the acoustic differential pressure created, and connected to the control means.

13. Acoustic equipment including the device of claim 12, arranged in a network, and controlled from the same reference signal, with appropriate respective delay laws, so as to shape the pairs of acoustic waves emitted to conform to adjustable forms and incidences.

14. Acoustic equipment including the device of claim 1, arranged in a network, and controlled from the same reference signal, with appropriate respective delay laws, so as to shape the pairs of acoustic waves emitted to conform to adjustable forms and incidences.

* * * * *